United States Patent [19]

Lugtmeier et al.

[11] Patent Number: 4,889,184

[45] Date of Patent: Dec. 26, 1989

[54] POLISHED ROD STUFFING BOX WITH SAFETY VALVE FOR A BEAM PUMPED PRODUCTION WELL

[75] Inventors: Lubbertus Lugtmeier; Albert Klamer, both of Abel Tasmanplein, Netherlands

[73] Assignee: Shell Internationale Research, The Hague, Netherlands

[21] Appl. No.: 194,607

[22] Filed: May 16, 1988

[30] Foreign Application Priority Data

May 27, 1987 [GB] United Kingdom ..... 8712456

[51] Int. Cl.[4] ..... E21B 33/03

[52] U.S. Cl. ..... 166/80; 166/84; 116/208; 137/551

[58] Field of Search ..... 166/80, 81, 84, 85, 166/87, 95, 113, 332, 334; 137/551, 553, 559; 116/208

[56] References Cited

U.S. PATENT DOCUMENTS

| | | | |
|---|---|---|---|
| 1,708,261 | 4/1929 | Crowell et al. . | |
| 1,771,250 | 7/1930 | Feild . | |
| 2,628,122 | 2/1953 | Collins et al. | 294/65.5 |
| 3,145,995 | 8/1964 | Adamson et al. | 277/28 |
| 3,438,351 | 4/1969 | Kirkwood | 116/208 |
| 3,468,374 | 9/1969 | Reeves | 166/84 |
| 3,887,196 | 6/1975 | Renfrow | 277/2 |
| 3,939,910 | 2/1976 | Bruce | 166/84 |
| 3,967,678 | 7/1976 | Blackwell | 166/84 X |
| 4,099,562 | 7/1978 | Mattoon | 166/80 X |
| 4,233,926 | 11/1980 | Rogers et al. | 116/208 |
| 4,289,294 | 9/1981 | McLean | 251/62 |
| 4,377,206 | 3/1983 | Chambers | 166/97 |
| 4,606,374 | 8/1986 | Kolenc et al. | 116/208 X |
| 4,640,372 | 2/1987 | Davis | 175/208 |
| 4,647,050 | 3/1987 | Johnson | 166/84 X |

FOREIGN PATENT DOCUMENTS 932353 8/1973 Canada .

*Primary Examiner*—William P. Neuder

*Attorney, Agent, or Firm*—Jones, Tullar & Cooper

[57] ABSTRACT

A wellhead assembly for a beam pumped production well comprises a stuffing box for providing a seal around a polished rod of the beam pump assembly and a flapper type safety valve for sealing off the wellhead in case of polished rod failure. The safety valve comprises a wear plate which is pressed against the polished rod and means are provided for monitoring the amount of wear of the wear plate on the basis of the angular orientation of the safety valve relative to the stuffing box.

7 Claims, 2 Drawing Sheets

POLISHED ROD STUFFING BOX WITH SAFETY VALVE FOR A BEAM PUMPED PRODUCTION WELL

The invention relates to a wellhead assembly for a beam pumped production well and in particular to a wellhead assembly comprising a polished rod stuffing box provided with a safety valve for sealing off the wellhead in case of polished rod failure.

Wellhead assemblies for beam pumped production wells generally comprise a stuffing box which prevents leakage of fluids from the well into the atmosphere. During operation the polished rod moves up and down while being subject to a combination of tension, bending and buckling forces. The high mechanical loads, in combination with poor tribological conditions and corrosion may occasionally lead to polished rod failure. In order to seal off the open space left in the stuffing box if the polished rod drops into the well after failure thereof currently available wellheads comprise a ball-type valve. During normal operation of the pump the ball is pressed against the polished rod by spring action and in case of polished rod failure the ball is pushed by the spring in the flow stream and subsequently against a valve seat, thereby sealing off the wellhead.

Field experience with wellhead assemblies of the above type has shown that the sealing capability of these ball valves may sometimes unexpectedly rapidly decrease due to unroundness of the ball as a result of wear. It is therefore necessary to regularly inspect these ball-type valves for wear. Inspection of these valves requires removal of the ball and interruption of production operations, and is therefore a time consuming and expensive procedure.

Thus there is a need for a wellhead assembly comprising a safety valve which requires less frequent maintenance and which can be inspected for wear without interrupting production operations.

It is therefore an object of the present invention to provide a wellhead assembly for a beam pumped production well which can be easily inspected and which provides a fluid tight wellhead seal under all circumstances.

The wellhead assembly according to the invention thereto comprises a stuffing box for providing a seal around a polished rod of the beam pump assembly and a flapper type safety valve for sealing off the wellhead in case of polished rod failure. The safety valve comprises a wear plate which is pressed against the polished rod and means are provided for monitoring the amount of wear of the wear plate on the basis of the angular orientation of the safety valve relative to the stuffing box.

In a preferred embodiment of the inventin the wear monitoring means consist of an arm which is secured at a location outside the stuffing box to a hinge pin carrying the flapper valve. Thus, if the wear plate wears away the resulting varying angular orientation of the flapper valve can be detected by monitoring the orientation of the arm.

Alternatively, the wear monitoring means may consist of a pin which can against the action of a spring be pressed against the flapper valve over a distance which corresponds to the amount of wear of the wear plate.

In both embodiments of the invention inspection of the wear condition of the wear plate can be carried out without interruption of the operation of the beam pump.

The invention will now be explained in more detail with reference to the accompanying drawings, in which.

Figure 1:
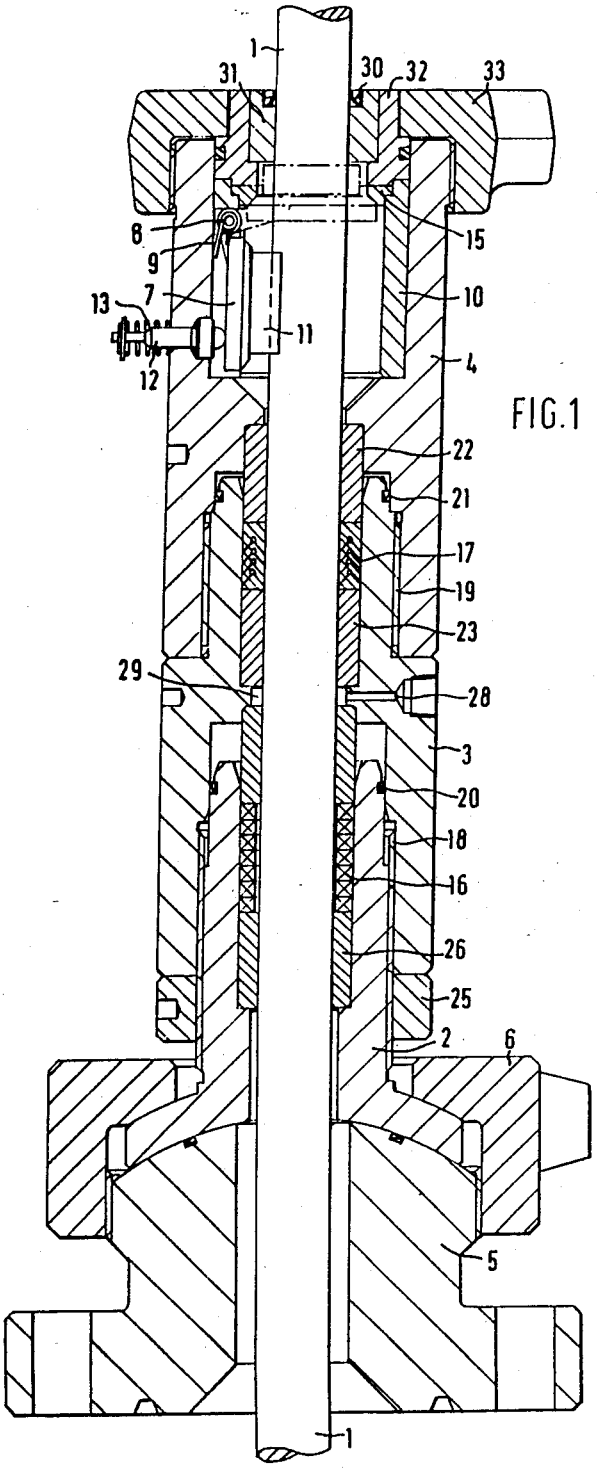
FIG. 1 is a vertical sectional view of a wellhead assembly according to the invention.

Referring now to FIG. 1 there is shown a wellhead assembly of a beam pumped oil production well. The polished rod 1 of the beam pump passes through a stuffing box consisting of three tubular elements 2, 3 and 4. The first tubular element 2 is clamped on a ball coupling 5 by means of a clamping nut 6. The second and third tubular elements 3 and 4 are screwed on top of the first element 2. The third tubular element 4 contains a housing 10 which carries a safety valve having a flapper type valve body 7.

The valve body 7 is secured to a horizontally oriented hinge pin 8 which allows the valve body to rotate between a first substantially horizontal position (as illustrated in phantom lines) and a second substantially vertical position. During operation of the beam pump the valve body is oriented in the second position thereof and a torsion spring 9 exerts a torque on the valve body 7 which induces the valve body to rotate in the direction of the first position thereof. In this manner a bronze or teflon wear plate 11 carried by the valve body 7 is pressed against the polished rod 1. A wear monitoring pin 12 is arranged behind the valve body 7. The pin 12 can, against the action of a spring 13, be pressed against the valve body 7. Since wear of the wear plate 11 will result in a rotation of the valve body 7 towards the first position thereof the depth over which the pin 12 can be pressed into the stuffing box corresponds to the amount of wear of the wear plate 11. Thus the amount of wear of the wear plate can be regularly controlled by operating personel without interruption of the pumping operations.

In case of failure of the polished rod 1 the rod 1 will fall into the well and the spring 9 will push the safety valve 7 to the first, horizontal, position thereof in which it lies against a valve seat 15 and closes the wellhead.

Since in case of polished rod failure the resulting decompression of packings 16 and 17 between the three tubular elements 2, 3 and 4 may cuase leakage of fluid from the well via the screw thread connections 18, 19 between said element back-up seal rings 20, 21 are provided in the annular spaces between said elements.

The upper packing 17 is composed of reinforced polytetrafluoroethylene and solids containing seal rings, which are held under axial compression by bronze bushings 22 and 23.

The upper packing 17 provides a seal around the polished rod 1 during operation of the beam pump. If inspection or replacement of the upper packing 17 is required pumping operations are interrupted and after loosening a counter nut 25 below the second tubular element 3 said second element 3 is screwed downwardly towards the first element 2 so as to axially compress the lower packing 16 via adjacent bronze bushings 26, 27. Then the lower packing 16 provides a seal around the polished rod 1 until the upper packing 17 has been replaced or inspected. Before unscrewing the second tubular element 3 again to raise it to its normal operative position a high pressure test liquid is injected via a test port 28 into the annular space 29 between the packings 16, 17 so as to test the fluid tightness of the packings.

To avoid early wearing of the packings 16, 17 and of the wear plate 11 and bushings 22, 23, 26 and 27 a flexible scraper ring 30 is arranged at the upper end of the wellhead assembly so as to remove solid particles such as dust or sand from the polished rod 1 as it moves down through the wellhead assembly. The scraper ring 30 is mounted in a bushing 31 which is fixed to a second bushing 32. Said second bushing 32 is locked to the wellhead assembly by a wing nut 33.

The wellhead assembly according to the invention is designed such that it can be safely operated without requiring frequent maintenance or repair operations. Thus it is of importance that the state of wear of the potentially wear-prone wear plate 11 of the safety valve can be monitored regularly, without requiring disassembling of the wellhead assembly.

Since even during maintenance or repair operations or after failure of the polished rod the wellhead is sealed off in a reliable manner the wellhead is particularly suitable for use in wells in reservoirs where steam injection takes place and where toxic or flammable gases such as hydrogen sulphide or methane could escape to the atmosphere via the wellhead.

Figure 2B:
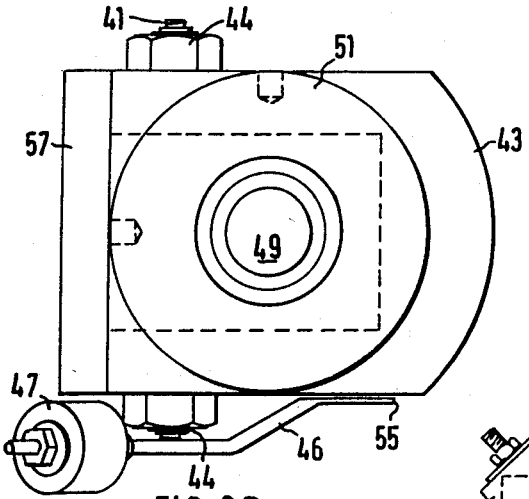
FIG. 2B is a top view of the wellhead of FIG. 2A.
Figure 2C:
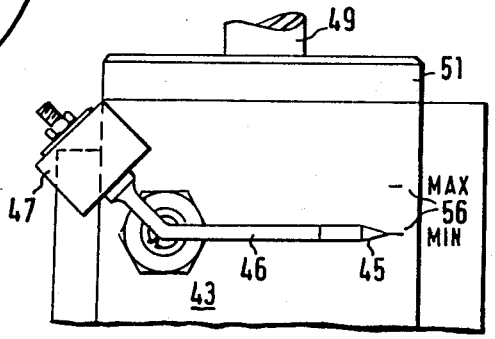
FIG. 2C is a side view of the wellhead of FIG. 2A.
Figure 2A:
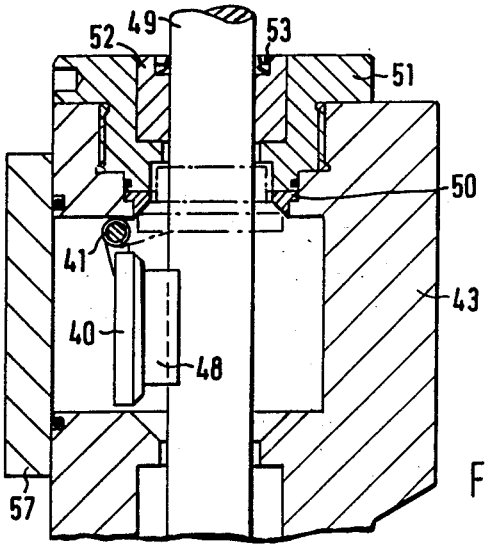
FIG. 2A is a vertical sectional view of the upper end of another wellhead assembly according to the invention.

FIGS. 2A, 2B and 2C show the upper part of an alternative safety valve construction in a wellhead assembly according to the invention. The safety valve shown in FIG. 2A–C comprises a flapper type valve body 40 carried by a hinge pin 41. The hinge pin 41 is rotatably connected to the stuffing box 43 by a pair of bearings 44. The hinge pin carries at a location outside the stuffing box 43 an arm 46 provided with a weight means 47.

The weight means 47 exerts a torque on the pin 41 thereby inducing the pin 41 and flapper valve body 40 to rotate in the left hand direction. In this manner a wear plate 48 carried by the valve body 40 is during normal operation of the beam pump pressed against the polished rod 49 of the pump, and in case of polished rod failure the valve body is rotated to a substantially horizontal position against a valve seat 50 so as to seal off the wellhead. The valve seat 50 is locked to the stuffing box 43 by a screw cap 51. The screw cap 51 houses a bushing 52 in which a scraper ring 53 is arranged.

The scraper ring 53 removes solid debris from the polished rod 49 as it moves down through the wellhead so as to avoid rapid wear of the wear plate and packings (not shown) of the wellhead assembly by such debris.

The arm enables easy monitoring of the wear condition of the wear plate 48 as the arm will rotate in left hand direction as the wear plate wears off. By providing the arm 46 with a pointer 55 and providing the outer surface of the stuffing box 43 with a wear indication scale 56 the wear condition of the wear plate 48 can be inspected continuously. In order to enable easy access to the safety valve if cleaning or more detailed inspection is required a removable plate 57 is secured to the stuffing box 43 at a location behind the valve body 40. After removal of the plate 57 and bearings 44 the valve body 40 can be easily removed from the wellhead and be inspected or replaced.

It will be understood that the flapper valve in the wellhead assembly according to the invention provides a more reliable wellhead seal than the known ball valve since the sealing capacity of the flapper valve remains unchanged as long as the wear plate has not completely worn away, whereas the sealing provided by a ball valve immediately reduces if the ball valve becomes unround because of wear. Because moreover in the wellhead assembly according to the the invention the amount of wear of the wear plate can be monitored accurately and without interruption of pumping operations the safe operation of the valve is maintained over a long interval of time whilst avoiding regular disassembling of the wellhead assembly for maintenance or inspection.

Thus it can be seen that the wellhead assembly according to the invention meets because of its high reliability the highest safety standards and is therefore particularly suitable for use in wells producing from oil reservoirs where steam injection takes place and hot or dangerous gases, such as methane or hydrogen sulphide, could escape via the wellhead to the atmosphere.

We claim:

1. A wellhead assembly for a beam pump assembly of a beam pumped production well, the assembly comprising a stuffing box for providing a seal around a polished rod of the beam pump assembly, said stuffing box comprising first, second and third tubular elements, which elements are co-axially arranged around the polished rod, said first element being mounted on top of a ball coupling, said second element at least partly surrounding and being screwed on top of said first tubular element and said third element at least partly surrounding and being screwed on top of said second element and said third tubular element carries a safety valve;

said safety valve comprising a flapper type valve body which is hingeably secured to the stuffing box in such a manner that in use a wear plate carried by the valve body is pressed against the polished rod;

means for monitoring the amount of wear of the wear plate on the basis of the angular orientation of the valve body relative to the stuffing box; and back-up seal rings between said first and second tubular elements and between said second and third tubular elements defining an annular space in which said back-up seal rings are arranged.

2. The wellhead assembly of claim 1, wherein the valve body is connected to the stuffing box by a horizontally oriented hinge pin such that the valve body is able to pivot about a substantially horizontal axis between a first substantially horizontal position and a second substantially vertical position.

3. The wellhead assembly of claim 2, wherein said wear monitoring means consist of an arm which is secured to said hinge pin at a location outside the stuffing box.

4. The wellhead assembly of claim 3, wherein said arm is provided with weight means which exert a predetermined torque on the hinge pin such that the valve body is induced to rotate from said second position towards said first position.

5. The wellhead assembly of claim 1, wherein said wear monitoring means consist of a pin which can against the action of a spring be pressed against the valve body over a distance corresponding to the amount of wear of the wear plate.

6. The wellhead assembly of claim 1, wherein between said second and third tubular element a soft packing is arranged which is during operation of the beam pump clamped around the polished rod by tightening the screw connection between said second and third tubular element and wherein between said first and second tubular element another soft packing is arranged which is during maintenance operations clamped around the polished rod by tightening the screw connection between said first and second tubular element.

7. The wellhead assembly of claim 6, wherein a test port is arranged in the wall of the second tubular element for injecting a pressurized test fluid into an annular space located between said soft packings.

* * * * *

UNITED STATES PATENT AND TRADEMARK OFFICE

CERTIFICATE OF CORRECTION

PATENT NO. : 4,889,184

DATED : December 26, 1989

INVENTOR(S) : Lubbertus Lugtmeier et al

It is certified that error appears in the above-identified patent and that said Letters Patent is hereby corrected as shown below:

Claim 1, column 4, line 32, "and said third tubular ele-" should be deleted.

Claim 1, column 4, line 33, "ment carries a safety valve" should be deleted.

Claim 1, column 4, line 34, "said" should be deleted, "a" should be inserted before "safety", and "carried by said third element" should be inserted before "comprising".

Signed and Sealed this

Twenty-fifth Day of December, 1990

*Attest:*

*Attesting Officer*

HARRY F. MANBECK, JR.

*Commissioner of Patents and Trademarks*